United States Patent [19]

Levi

[11] 4,422,672

[45] Dec. 27, 1983

[54] INDEX SHEET

[76] Inventor: Kurt L. Levi, 80 Wingold Ave., Toronto, Ontario, Canada

[21] Appl. No.: 298,173

[22] Filed: Aug. 31, 1981

[51] Int. Cl.[3] ..... B42F 21/02; B42D 9/00; B42D 13/00

[52] U.S. Cl. ..... 283/39; 402/80 R; 412/9; 412/901; 283/66 R

[58] Field of Search ..... 283/36, 37, 38, 39, 283/66 R; 402/79, 80 R; 412/4, 6, 8, 9, 900, 901

[56] References Cited

U.S. PATENT DOCUMENTS 1,241,049 9/1917 Stevens ..... 283/36
4,315,697 2/1982 Horowitz ..... 283/66 R X
4,329,191 5/1982 Barber ..... 283/36 X

FOREIGN PATENT DOCUMENTS 6711263 2/1969 Netherlands ..... 412/901

*Primary Examiner*—Paul A. Bell

[57] ABSTRACT

An index sheet for a bound volume consisting of a panel of flexible material, having a width corresponding to the width of the pages of the volume, a tab on the right-hand edge of the panel to carry indicia, adhesive on the left-hand edge of the panel, and a removable cover for the adhesive which can be removed when the panel is inserted between the pages of the volume thus securing the panel in position.

5 Claims, 3 Drawing Figures

INDEX SHEET

The invention relates to an index sheet, for insertion in a bound book, and in particular to a removable index sheet, which may be used more than once.

BACKGROUND OF THE INVENTION

Numerous proposals have been made for providing indexing tabs, or incorporating indexing pages in large books such as dictionaries, directories and the like.

For example, in some cases, index tabs are actually incorporated on the pages themselves, or alternatively the pages may be die cut with indentations. These systems are relatively expensive and are only suitable for more or less permanent books such as dictionaries, where the price of the article justifies the extra cutting required.

In other forms of directories, particularly those such as telephone directories which are replaced yearly, the use of such indexing tabs, or indexing recesses, is not practical for various reasons. For example, it would greatly increase the cost of printing the directory, and this would have to be passed on to the consumer. Another factor is the quality of the paper. In most cases, such annual directories are produced on fairly cheap paper such that it becomes easily torn. Consequently, indexing tabs on such pages are virtually useless. Cutting out indexing recesses becomes too complicated.

Indexing systems are available which can be attached to certain types of directories and books. However, again, such tabs are usually attached to the pages themselves. Where the directory is printed on cheap paper, then the tabs are immediately torn off.

Clearly, there is a need for indexing in such directories, particularly as they increase in size every year. Preferably, however, such an indexing system should be provided as an extra feature, and not as part of the directory, which would simply increase the overall cost of the directory. In this way, it will become possible to supply an indexing system separately to the consumer who may then purchase it or not, as he wishes.

BRIEF SUMMARY OF THE INVENTION

With a view to providing these various features, the invention comprises an index sheet for a bound volume, having pages of predetermined width and height, said indexing sheets comprising a panel of flexible sheet material, having a predetermined width and height corresponding at least to the width of said pages of said volume, tab means on said panel on the right hand edge thereof, and extending outwardly from said edge, and adapted to carry indexing indicia, and pressure sensitive adhesive means on the left hand edge of said panel, and a plurality of removable cover strips covering said adhesive means and arranged in end-to-end alignment in a single row whereby when one of said cover strips is removed, a portion of said adhesive means is exposed, while the remainder of said cover strips remain in position covering the remainder of such adhesive strip in such row and said panel is inserted between the pages of said volume with said adhesive means adjacent the left-hand edges of said pages, said exposed portion of said adhesive means secures said panel in position with said tab means extending outwardly from the right-hand edge of said volume, exposing same to view, removal of one of said cover strips leaving the remainder thereof in such row undisturbed whereby said panel may be inserted into one said volume and used and may then be removed therefrom, and by removing a further one of said cover strips, said panel may then be inserted elsewhere.

The invention further comprises such an index sheet wherein said cover means is formed in a plurality of separate sections, removal of one section of said cover means leaving the remainder thereof undisturbed, whereby said panel may be inserted into one said volume and used, and may then be removed therefrom, and, by removing a further section of said cover means, said panel may then be inserted into a further volume.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 2:
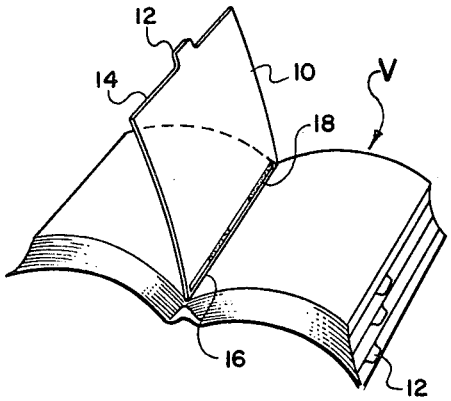
FIG. 2 is a perspective illustration of the volume of FIG. 1, opened up, showing an indexing sheet between the two leaves of the the volume, and, FIG. 3 is a plan view of the indexing sheet.
Figure 1:
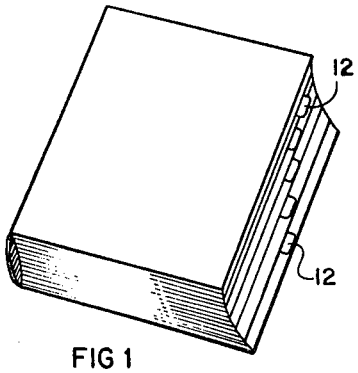
FIG. 1 is a perspective illustration showing a volume with the indexing sheets in place.

Referring now to the drawings, it will be seen that FIGS. 1 and 2 show a volume V, typically being a telephone directory, having index sheets indicated generally as 10 inserted therein. For the sake of illustration only a small number of such index sheets 10 are shown. In the normal instance, however, as many as twenty-six index sheets might be prepared, one for each letter of the alphabet, or sheets having a variety of different combinations of numbers and/or letters can be prepared, the invention not being limited to any particular number of such index sheets, the number shown being merely chosen for the sake of illustration only.

It is apparent that each of the index sheets 10 is provided with a visible tab 12 which extends outwardly from the right-hand edges of the pages of the volume. Each of the sheets 10 will be seen to be of the same width as the pages of the volume V, so as to provide an easy means of opening the volume V at the designed indexing point without damaging the pages of the volume. Preferably the sheets 10 will also be of the same height as the pages of the volume.

In most cases each of the tabs 12 will bear some suitable indicia. This, of course, may simply be the letters of the alphabet. On the other hand, in a trade directory for example, the indicia may be in the form of the subject headings or classifications of the directory. In any event, whatever indicia are used, the invention is deemed to be equally applicable thereto without departing from the scope of the invention. Blank tabs 12 may also be used if desired.

Figure 3:
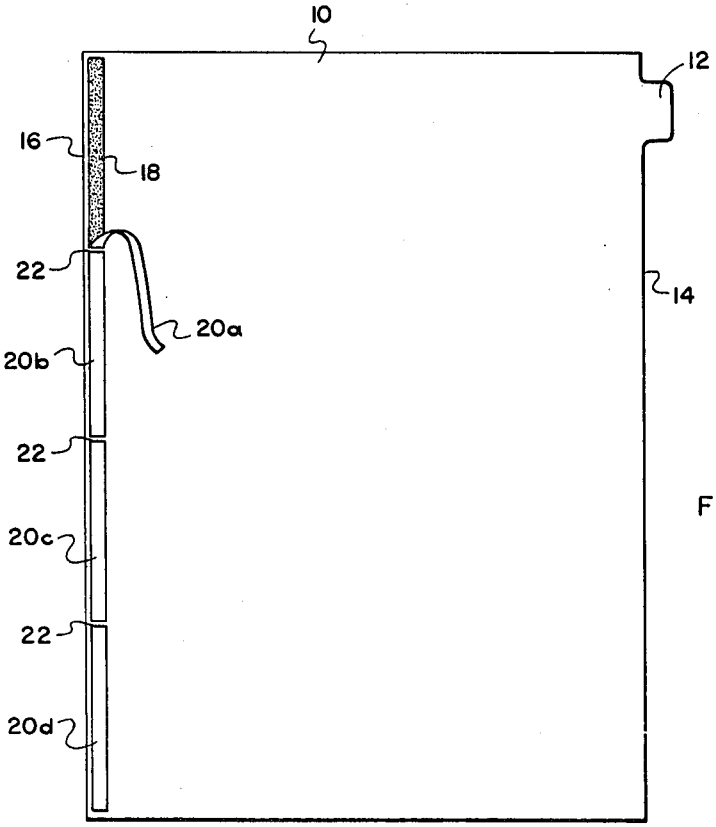

As shown in more detail in FIG. 3, the indexing sheet 10 will be seen to comprise a rectangular panel, with a tab 12 die cut integrally therewith on the right-hand edge, such edge being designated as 14. Preferably, although not exclusively, the panel 10 and tab 12 are formed of a single sheet of clear plastics material, of sufficient thickness that it will stand up to the intended usage, without being so thick as to interfere with the binding of the volume. If desired, the tab 12 could be formed separately, and could be bonded to the panel 10 by any suitable bonding or fastening means so as to form the whole into an integral structure. In the preferred case, however, it is felt that a neater, more satisfactory result is provided by simply die cutting the panel 10 and tab 12 out of a single larger blank of material.

Along the left-hand edge of panel 10 designated as 16, a fastening strip of pressure-sensitive adhesive material 18 is provided. The adhesive strip 18 is in turn covered by a plurality of sections of removable cover strip material 20*a*, 20*b*, 20*c*, and 20*d*. These strips of cover material may simply be paper or the like as is well known in the art. They are separated by incisions 22. In this way one such cover strip 20*a* may be peeled off, without disturbing the remainder 20*b*, *c*, and *d*. The strip 18 can also be discontinuous if desired.

With one length of the adhesive strip 18 exposed in this way, the left-hand edge 16 of the panel 10 is then inserted into the open pages of the volume V essentially as shown in FIG. 2. The volume is then closed, and light pressure may be applied if desired. The panel 10 will then be found in the majority of cases to be secured sufficiently well that the volume may then by handled, and the indexing tab 12 of the panel 10 may be used, without removing the panel 10 from its position.

If the volume is receiving substantial and continual use it may be desirable to expose more of the adhesive strip 18 by removing more of the cover strips 20*a*, *b*, *c*, and *d*. In the normal case, however, it is intended that the remaining cover strips shall be left in place. When a new volume or directory is obtained, the panel 10 may simply be ripped out. A new section of the cover strip, for example 20*b*, may then be removed, thus exposing a further section of the adhesive 18, which will then be used for securing the panel 10 in position in the new volume.

In this way the indexing sheet 10 may be used for several years in succession.

The invention will thus be seen to provide an insertable index page which can be inserted into an already bound volume, and which may be fastened in the volume, and which after the volume has been discarded, can simply be removed from the volume and used over again in a new volume.

If desired, each index sheet can be printed, for example to carry advertising, or special information of interest to the user.

The foregoing is a description of a preferred embodiment of the invention which is given here by way of example only. The invention is not to be taken as limited to any of the specific features as described, but comprehends all such variations thereof as come within the scope of the appended claims.

I claim:

1. An index sheet for a bound volume, having pages of predetermined width and height, said index sheet comprising;

a rectangular panel of flexible sheet material, having a predetermined width corresponding at least to the width of said pages of said volume;

tab means on said panel on the right-hand edge thereof, and extending outwardly from said edge, and adapted to carry indexing indicia;

a pressure sensitive adhesive strip on the left-hand edge of said panel, and, a plurality of removable cover strips covering said adhesive strip and arranged in end-to-end alignment in a single row whereby when one of said cover strips is removed, a portion of said adhesive strip is exposed, while the remainder of said cover strips remain in position covering the remainder of such adhesive strip in such row and said panel is inserted between the pages of said volume with said adhesive strip adjacent the left-hand edges of said pages, said exposed portion of said adhesive strip secures said panel in position with said tab means extending outwardly from the right-hand edge of said volume, exposing same to view, removal of one of said cover strips leaving the remainder thereof in such row undisturbed whereby said panel may be inserted into one said volume and used and may then be removed therefrom, and by removing a further one of said cover strips, said panel may then be inserted elsewhere.

2. An index sheet as claimed in claim 1 wherein said panel is formed of transparent flexible sheet material.

3. An index sheet as claimed in claim 2 wherein said panel has a predetermined height corresponding to the height of the pages of said volume.

4. A plurality of index sheets as claimed in claim 3 wherein said respective tabs are located at different locations on respective said right-hand edges of said panels.

5. A set of index sheets for indexing a bound volume, such volume having pages of predetermined width and height, such set of index sheets comprising a plurality of separate index sheets each having;

a rectangular panel of flexible sheet material, having a predetermined width corresponding at least to the width of the said pages of said volume;

tab means on said panel on the right-hand edge thereof, and extending outwardly from said edge and adapted to carry indexing indicia, and dimensioned to extend outwardly from the width of said pages of said volume, individual said tab means being offset with respect to one another in said set;

a continuous pressure sensitive adhesive strip along the left-hand edge of each said panel, and, a plurality of removable cover strips, each such cover strip being separate from the next adjacent said cover strip, and being arranged end-to-end along the length of such adhesive strip, removal of one of said cover strips exposing a portion of said adhesive strip, while leaving the remainder of said strip being covered by the remainder of said cover strips, whereby when one of said cover strips is removed, and said panel is inserted between the pages of said volume with said adhesive strip adjacent the left-hand edges of said pages, said exposed portion of said adhesive strips secures said panel in position, with said tab means extending outwardly from the right-hand edge of said volume exposing the same to view, and whereby said panel may be removed from it's position in said volume, and reused by merely removing a further said cover strip from said adhesive strip, thereby exposing a fresh portion of said adhesive strip for re-fastening of said panel.

* * * * *